US007452851B2

(12) United States Patent
Devlin et al.

(10) Patent No.: US 7,452,851 B2
(45) Date of Patent: Nov. 18, 2008

(54) LUBRICANT COMPOSITIONS

(75) Inventors: Mark T. Devlin, Richmond, VA (US); Helen T. Ryan, London (GB)

(73) Assignee: Afton Chemical Corporation, Richmond, WA (US)

( * ) Notice: Subject to any disclaimer, the term of this patent is extended or adjusted under 35 U.S.C. 154(b) by 406 days.

(21) Appl. No.: 10/693,197

(22) Filed: Oct. 24, 2003

(65) Prior Publication Data

US 2005/0090409 A1 Apr. 28, 2005

(51) Int. Cl.

| | |
|---|---|
| ***C09K 15/10*** | (2006.01) |
| ***C09K 15/16*** | (2006.01) |
| ***C09K 15/24*** | (2006.01) |
| ***C09K 15/26*** | (2006.01) |

(52) U.S. Cl. ..... 508/543; 508/556; 508/561; 508/564; 508/565; 508/567; 252/18; 252/45; 252/48; 252/48.6; 252/48.9

(58) Field of Classification Search ..... 252/18, 252/45, 48, 48.6, 49.6; 508/543, 556, 561, 508/564, 565, 567

See application file for complete search history.

(56) References Cited

U.S. PATENT DOCUMENTS

| | | | | |
|---|---|---|---|---|
| 4,107,168 | A | 8/1978 | Okorodudu | |
| 4,209,408 | A | 6/1980 | Hoke | |
| 4,584,113 | A * | 4/1986 | Walsh | 508/331 |
| 5,176,840 | A | 1/1993 | Campbell et al. | |
| 5,254,272 | A | 10/1993 | Walters et al. | |
| 5,344,579 | A | 9/1994 | Ohtani et al. | |
| 5,354,484 | A | 10/1994 | Schwind et al. | |
| 5,358,650 | A | 10/1994 | Srinivasan et al. | |
| 5,441,656 | A | 8/1995 | Ohtani et al. | |
| 5,443,744 | A | 8/1995 | Bloch et al. | |
| 5,464,549 | A | 11/1995 | Sieberth | |
| 5,468,403 | A | 11/1995 | Romanelli et al. | |
| 5,492,638 | A | 2/1996 | Wallace et al. | |
| 5,573,696 | A | 11/1996 | Hughes et al. | |
| 5,587,432 | A | 12/1996 | Scattergood | |
| 5,612,295 | A | 3/1997 | Bell et al. | |
| 5,691,283 | A | 11/1997 | Poat et al. | |
| 5,700,764 | A | 12/1997 | Walters et al. | |
| 5,763,372 | A | 6/1998 | Tersigni et al. | |
| 5,843,874 | A | 12/1998 | Macpherson et al. | |
| 5,942,470 | A | 8/1999 | Norman et al. | |
| 6,030,930 | A * | 2/2000 | Emert et al. | 508/312 |
| 6,096,691 | A | 8/2000 | Conary et al. | |
| 6,184,186 | B1 | 2/2001 | Ryan et al. | |
| 6,482,777 | B2 | 11/2002 | Cain | |
| 6,573,223 | B1 | 6/2003 | Vinci | |
| 2002/0151443 | A1 * | 10/2002 | Srinivasan | 508/273 |

FOREIGN PATENT DOCUMENTS

| | | |
|---|---|---|
| EP | 0 620 268 A1 | 10/1994 |
| JP | 2-298590 | 12/1990 |
| JP | 5-209186 | 8/1993 |
| JP | 2001-311090 | 11/2001 |
| WO | WO 00/01790 | 1/2000 |

* cited by examiner

*Primary Examiner*—Kriellion A Sanders
(74) *Attorney, Agent, or Firm*—MH2 Technology Law Group LLP

(57) ABSTRACT

Lubricant compositions having improved anticorrosion performance comprising an extreme pressure compound comprising a sulfur-containing compound, an antiwear compound comprising a phosphorous-containing compound, an alkylene amine friction modifying compound, a dispersant compound containing basic nitrogen, and a diluent or base oil as applicable, wherein any of compounds other than the diluent or base oil can be the same or different compounds. These lubricant compositions provide improved anticorrosion resistance and fatigue performance, which prolongs service lives of lubricated parts, especially those used in outdoor applications.

27 Claims, No Drawings

LUBRICANT COMPOSITIONS

TECHNICAL FIELD

This invention generally relates to new and highly useful lubricant compositions, and, more particularly, this invention relates to new gear oil additive concentrates and gear oils containing them which reduce service needs of lubricated parts over long periods of use.

BACKGROUND OF THE INVENTION

Sulfur and phosphorous-containing compounds are commonly used to prevent wear and improve the load-carrying capacities of lubricants. However, sulfur and phosphorous-containing compounds have the drawback in that they can be corrosive, which impairs the performance of lubricants into which they are incorporated.

Corrosion also is a greater concern in outdoor applications of such lubricants involving wet, moist or humid environments. For instance, wind turbine applications, such as those used in wind farms or wind plants as an alternative renewable source of energy, are increasingly attracting more interest. Wind-electric turbine generators, also known as wind turbines, use the energy contained in the wind to spin a rotor (i.e., blades and hub). As the air flows past the rotor of a wind turbine, the rotor spins and drives the shaft of an electric generator to produce electricity. Wind turbine usage is increasing throughout the world, with about a three-fold increase in power generated from wind turbines occurring between 1998 and 2001 alone. Pohlen, J., "Lubricants for Wind Power Plants", NLGI Spokesman 67(2), 8-16, (2003). To create this energy using a conventional wind turbine, a gear-box is typically placed between the rotor of the wind turbine and the rotor of a generator. More specifically, the gear-box connects a low-speed shaft turned by the wind turbine rotor at about 30 to 60 rotations per minute to a high speed shaft that drives the generator to increase the rotational speed up to about 1200 to 1600 rpm, the rotational speed required by most generators to produce electricity. This geared solution can result in a torque through the system of close to 2 million N*m. Pohlen, J., "Lubricants for Wind Power Plants", NLGI Spokesman 67(2), 8-16, (2003). This high torque can put a large amount of stress on the gears and bearings in the geared wind turbine. Wind turbine oils are desired that will enhance the fatigue life of both the bearings and gears in the wind turbines.

In addition, wind turbines normally are located where wind is most plentiful, including coastlines and offshore locations, as well as in inland locations that are occasioned by atmospheric moisture in the form of rain and/or humidity. These severe environments may place additional performance demands on the lubricants required for wind turbines. For instance, exposure of such wind turbine devices to the elements as part of their basic functionality increases the risk of corrosion problems in the mechanical parts of the wind turbine. Furthermore, due to the remote locations of many wind turbines, frequent replacement of wind turbine oils is not practical or cost-effective, and thus these oils need to be more oxidatively stable than industrial lubricants used in many other applications. In addition, there is a high probability that water may contaminate the lubricating fluid. Ideally wind turbine lubricating oils should prevent corrosion, be hydrolytically stable, and increase the fatigue life of gears and bearings in the presence of water. Due to these concerns, wind turbine manufacturers are developing new lubricant specifications for wind turbine oils imposing very stringent fatigue life requirements, and also requirements for performance testing in the presence of water.

Gearless direct drive wind turbines have been developed, which have the advantage of having less moving parts to maintain, but have their own drawbacks of generally being heavier and generally being open models allowing cold air to pass through, which may pose an increased risk of corrosion, especially in offshore installations. In any event, it is expected that both types of wind turbines will co-exist for some time. Therefore, wind turbine oils that would enhance the fatigue life of bearings and gears in gear-boxes used in geared wind turbines would increase the opportunities to use the geared solution in the most efficient, reliable and cost-effective manner.

More generally, inasmuch as gear oils are often subjected to prolonged periods of use between any maintenance and service intervals, such as in wind turbines, as well as in vehicular differentials and like devices, it generally is important to provide gear oil additive systems capable of rendering improved service performance over lengthy durations of time. Moreover, additive combinations that improve the anti-corrosion properties of lubricating fluids containing sulfur and/or phosphorous compounds over long periods of time in service are needed, especially for outdoor applications, such as in geared wind turbines. In addition, while acceptable performance of the lubricating oil is needed, it is also highly desirable that the additive or additives be cost-attractive and conveniently manufactured.

SUMMARY OF THE INVENTION

The present invention provides compositions containing sulfur and phosphorous compounds, which have improved anti-corrosion and fatigue performance. The enhanced compositions of the present invention include lubricant compositions and functional fluids.

In one embodiment, this invention provides additive systems capable of imparting these anti-corrosion and fatigue performance enhancements to lubricant compositions for relatively lengthy periods of time, even in outdoor applications that otherwise might increase corrosion risks. In one particular embodiment of this invention, the improved lubricant compositions are gear oil additive concentrates and gear oils containing sulfur and phosphorous compounds. For purposes herein, the terminology "gear oils" refers collectively to industrial and automotive gear oils, and the terminology "lubricant compositions" refers collectively to additive concentrates and finished lubricants. In one of its embodiments this invention provides a top treat additive concentrate which comprises:

a) an extreme pressure compound comprising a sulfur-containing compound;

b) an antiwear compound comprising a phosphorous-containing compound;

c) a friction modifying compound comprising an alkylene amine compound;

d) a dispersant compound containing basic nitrogen; and e) a diluent oil, wherein any of compounds a), b), c) and d) can be the same or different compounds.

In one particular embodiment, the extreme pressure compound comprising a sulfur-containing compound and the antiwear compound comprising a phosphorous-containing compound are different chemical compounds present in the additive concentrate, while in another they are the same chemical compound which is multi-functional. In an alternative embodiment, the friction modifying compound comprising an alkylene amine compound and the dispersant compound containing basic nitrogen are different chemical compounds, while in another they are the same chemical compound which is a multi-functional compound.

In another embodiment, there is a gear lubricant composition comprising a major amount of an oil of lubricating viscosity and a minor amount of the above-described additive concentrate.

In one embodiment, lubricant compositions of embodiments of the present invention can be used as lubricating gear oils having prolonged service lives, even in severe outdoor environments. The lubricant compositions of embodiments of the present invention provide highly useful and enhanced antiwear and fatigue life performance despite the presence of sulfur and phosphorous-based compounds that might otherwise be expected to adversely impact the corrosion resistance and fatigue life of the lubricant composition. However, the further inclusion of the combination of the friction modifying alkylene amine and the dispersant compound containing basic nitrogen in the lubricant compositions of embodiments of the present invention has been surprisingly found to synergistically act to improve the anti-corrosion properties of the lubricant composition to effectively offset those tendencies. As demonstrated in experimental studies described herein, it has been discovered that inclusion of the friction modifying alkylene amine and the dispersant compound containing basic nitrogen in the lubricant composition inhibits the occurrence of corrosion while useful wear and fatigue life performance is still provided. The lubricant compositions of the present invention help prevent wear, pitting, spalling, and scoring and promotes longer tooth life and smooth gear changes while protecting against corrosion, oxidation and foaming.

Lubricant compositions of embodiments described herein are useful as industrial and automotive gear oils, among other lubrication applications. For instance, they can be used to lubricate mechanical parts in gear-boxes of wind turbines. The lubricant compositions also can be used in automotive, heavy-duty truck and bus manual transmissions, and rear axles. They are especially well-adapted for long service-life gear oil applications, such as encountered in gear boxes of wind turbines, vehicular differentials, and like devices. Additive concentrates and compositions of embodiments of the present invention also may be used in functional fluids, such as automotive transmission fluids.

DETAILED DESCRIPTION OF THE PREFERRED EMBODIMENTS

The present invention generally relates to compositions including a sulfur-containing compound and a phosphorous-containing compound, or a compound containing both chemistries, that also contains a combination of a friction modifying alkylene amine compound and a dispersant compound containing basic nitrogen, as separate compounds or as a single multi-functional compound, that synergistically acts to improve the anti-corrosion and fatigue properties of the lubricant composition. Lubricant compositions of this invention encompass additive concentrates and finished lubricants. These lubricant compositions can be used, for example, for gear oil additive concentrates and gear oils. Other functional fluids, as automotive transmission fluids, also can incorporate the compositions of this invention. One non-limiting embodiment of the present invention relates to the development of a gear oil well-suited for wind turbine applications and like devices which are often deployed in wet, damp or humid environments.

Experimental studies have been undertaken, which are reported herein, show that water contamination and oil oxidation can increase the corrosivity of lubricant oils and decrease their ability to form protective films. These fluid property changes can significantly reduce the ability of oils to enhance fatigue life. Experimental results reported herein have confirmed a correlation between film formation and frictional properties of lubricants to calculated fatigue life in terms of predicted time to pitting failure in FZG tests. The lubricants of the present invention can improve fatigue life by reducing friction, forming films to reduce the number of asperity contacts, and controlling corrosion. Since fatigue life is related to a fluid's ability to reduce friction, form films and prevent corrosion, the effect of water contamination and oxidation on these critical fluid properties is addressed by this invention.

However, it will be appreciated that lubricants of this invention have wide applications encompassing industrial and automotive gear oil applications. The lubricants are especially well-suited for gear oil applications in which improved fatigue performance and longer service lives are demanded or highly desirable, such as in wind turbine gear boxes and vehicular differential applications.

Sulfur-containing Extreme Pressure Agents (Compound a))

The lubricant compositions of the present invention contain at least one sulfur-containing extreme pressure (EP) agent. A wide variety of sulfur-containing extreme pressure are available for use in the practice of this invention. Among suitable compositions for this use are included sulfurized animal or vegetable fats or oils, sulfurized animal or vegetable fatty acid esters, fully or partially esterified esters of trivalent or pentavalent acids of phosphorus, sulfurized olefins (see for example U.S. Pat. Nos. 2,995,569; 3,673,090; 3,703,504; 3,703,505; 3,796,661; 3,873,545; 4,119,549; 4,119,550; 4,147,640; 4,191,659; 4,240,958; 4,344,854; 4,472,306; and 4,711,736), dihydrocarbyl polysulfides (see for example U.S. Pat. Nos. 2,237,625; 2,237,627; 2,527,948; 2,695,316; 3,022,351; 3,308,166; 3,392,201; 4,564,709; and British 1,162,334), sulfurized Diels-Alder adducts (see for example U.S. Pat. Nos. 3,632,566; 3,498,915; and Re 27,331), sulfurized dicyclopentadiene (see for example U.S. Pat. Nos. 3,882,031 and 4,188,297), sulfurized or co-sulfurized mixtures of fatty acid esters and monounsaturated olefin (see for example U.S. Pat. Nos. 4,149,982; 4,166,796; 4,166,797; 4,321,153; 4,481,140), co-sulfurized blends of fatty acid, fatty acid ester and α-olefin (see for example U.S. Pat. No. 3,953,347), functionally-substituted dihydrocarbyl polysulfides (see for example U.S. Pat. No. 4,218,332), thia-aldehydes, thia-ketones and derivatives thereof (e.g., acids, esters, imines, or lactones) (see for example, U.S. Pat. No. 4,800,031; and PCT International Application Publication No. WO 88/03552), epithio compounds (see for example, U.S. Pat. No. 4,217,233), sulfur-containing acetal derivatives (see for example U.S. Pat. No. 4,248,723), co-sulfurized blends of terpene and acyclic olefins (see for example U.S. Pat. No. 4,584,113), sulfurized borate compounds (see for example U.S. Pat. No. 4,701,274), and polysulfide olefin products (see for example U.S. Pat. No. 4,795,576). The disclosures of the foregoing patents are incorporated herein by reference.

Preferred materials useful as the sulfur-containing extreme pressure component are sulfur-containing organic compounds in which the sulfur-containing species are bound directly to carbon or to more sulfur.

One particularly preferred class of such agents is made by reacting an olefin, such as isobutene, with sulfur. The product, e.g., sulfurized isobutene, preferably sulfurized polyisobutylene, typically has a sulfur content of 10 to 55%, preferably 30 to 50% by weight. A wide variety of other olefins or unsaturated hydrocarbons, e.g., isobutene dimer or trimer, may be used to form such agents.

Another particularly preferred class of such agents is that of polysulfides composed of one or more compounds represented by the formula: $R_a—S_x—R_b$ where $R_a$ and $R_b$ are hydrocarbyl groups each of which preferably contains 3 to 18 carbon atoms and x is preferably in the range of from 2 to 8, and more preferably in the range of from 2 to 5, especially 3. The hydrocarbyl groups can be of widely varying types such as alkyl, cycloalkyl, alkenyl, aryl, or aralkyl. Tertiary alkyl polysulfides such as di-tert-butyl trisulfide, and mixtures comprising di-tert-butyl trisulfide (e.g., a mixture composed principally or entirely of the tri, tetra-, and pentasulfides) are preferred. Examples of other useful dihydrocarbyl polysulfides include the diamyl polysulfides, the dinonyl polysulfides, the didodecyl polysulfides, and the dibenzyl polysulfides, among others.

In one embodiment, the sulfur-containing extreme pressure agents contain at least 25 percent by weight sulfur. In one embodiment, the amount of said EP agent added to the finished gear oil will be sufficient to provide at least 1,000 ppm sulfur, more preferably 1,000 to 20,000 ppm sulfur and most preferably 2,000 to 12,000 ppm sulfur in the finished gear oil.

As used herein, the terminology "hydrocarbyl substituent" or "hydrocarbyl group" is generally used in its ordinary sense, which is well-known to those skilled in the art. Specifically, it refers to a group having a carbon atom directly attached to the remainder of the molecule and having predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of this invention, do not alter the predominantly hydrocarbon substituent (e.g., halo (especially chloro and fluoro), hydroxy, alkoxy, mercapto, alkylmercapto, nitro, nitroso, and sulfoxy);

(3) hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl.

In general, no more than two, preferably no more than one, non-hydrocarbon substituent will be present for every ten carbon atoms in the hydrocarbyl group; typically, there will be no non-hydrocarbon substituents in the hydrocarbyl group.

Phosphorus-containing Anti-Wear Agents (Compound b))

The lubricant compositions of the present invention contain at least one thermally stable phosphorus-containing anti-wear agent. Suitable phosphorus-containing anti-wear agents include oil-soluble amine salts or amine adducts of a phosphoric acid ester, such as those taught in U.S. Pat. Nos. 5,354,484, 5,763,372, and 5,942,470. The phosphorus-containing anti-wear agents also may be the reaction product of dicyclopentadiene and a thiophosphoric acid.

The amine salts or adducts of a phosphoric acid ester may be prepared by reacting a phosphoric acid ester with ammonia or a basic nitrogen compound, such as an amine. The salts may be formed separately, and then the salt of the phosphoric acid ester may be added to the lubricating composition.

The phosphoric acid esters useful in preparing the amine salts of the present invention may be characterized by the formula

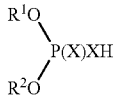

(I)

wherein $R^1$ is hydrogen or a hydrocarbyl group, $R^2$ is a hydrocarbyl group, and both X groups are either O or S.

A preferred method of preparing compositions containing (I) comprises reacting at least one hydroxy compound of the formula ROH with a phosphorus compound of the formula $P_2X_5$ wherein R is a hydrocarbyl group and X is O or S. The phosphorus-containing compositions obtained in this manner are mixtures of phosphorus compounds, and are generally mixtures of mono- and dihydrocarbyl-substituted phosphoric and/or dithiophosphoric acids depending on a choice of phosphorus reactant (i.e., $P_2O_5$ or $P_2S_5$).

The hydroxy compound used in the preparation of the phosphoric acid esters of this invention are characterized by the formula ROH wherein R is a hydrocarbyl group. The hydroxy compound reacted with the phosphorus compound may comprise a mixture of hydroxy compounds of the formula ROH wherein the hydrocarbyl group R contains from about 1 to 30 carbon atoms. It is necessary, however, that the amine salt of the substituted phosphoric acid ester ultimately prepared is soluble in the lubricating compositions of the present invention. Generally, the R group will contain at least 2 carbon atoms, typically 3 to 30 carbon atoms.

The R group may be aliphatic or aromatic such as alkyl, aryl, alkaryl, aralkyl and alicyclic hydrocarbon groups. Examples of useful hydroxy compounds of the formula ROH includes, for example, ethyl alcohol, iso-propyl, n-butyl alcohol, amyl alcohol, hexyl alcohol, 2-ethyl-hexyl alcohol, nonyl alcohol, dodecyl alcohol, stearyl alcohol, amyl phenol, octyl phenol, nonyl phenol, methyl cyclohexanol, alkylated naphthol, etc.

The preferred alcohols, ROH, are aliphatic alcohols and more particularly, primary aliphatic alcohols containing at least about 4 carbon atoms. Accordingly, examples of the preferred monohydric alcohols ROH which are useful in the present invention include, amyl alcohol, 1-octanol, 1-decanol, 1-dodecanol, 1-tetradecanol, 1-hexadecanol, 1-octadecanol, oleyl alcohol, linoleyl alcohol, linolenyl alcohol, phytol, myricyl alcohol, lauryl alcohol, myristyl alcohol, cetyl alcohol, stearyl alcohol and behenyl alcohol. Commercial alcohols (including mixtures) are contemplated herein, and these commercial alcohols may comprise minor amounts of alcohols which, although not specified herein, do not detract from the major purposes of this invention.

The molar ratio of the hydroxy compound ROH to phosphorus reactant $P_2X_5$ in the reaction should be within the range of from about 1:1 to about 4:1, the preferred ratio being 3:1. The reaction may be effected simply by mixing the two reactants at an elevated temperature such as temperatures above about 50° C. up to the composition temperature of any of the reactants or the desired product. Preferably, the temperature is between about 50° C. and 150° C., and is most often below about 100° C. The reaction may be carried out in the presence of a solvent which facilitates temperature control and mixing of the reactants. The solvent may be any inert fluid substance in which either one or both reactants are soluble, or the product is soluble. Such solvents include benzene, toluene, xylene, n-hexane, cyclohexane, naphtha, diethyl ether carbitol, dibutyl ether dioxane, chlorobenzene, nitrobenzene, carbon tetrachloride or chloroform.

The product of the above reaction is acidic, but its chemical constitution is not precisely known. Evidence indicates, however, that the product is a mixture of acidic phosphates consisting predominantly of the mono- and di-esters of phosphoric acid (or thio- or dithiophosphoric acid), the ester group being derived from the alcohol ROH.

The amine salts of the present invention can be prepared by reaction of the above-described phosphoric acid esters such as represented by Formula I with at least one amino compound which may be a primary or secondary. Preferably the amines which are reacted with the substituted phosphoric acids to form the amine salts are primary hydrocarbyl amines having the general formula: $R'NH_2$, wherein R' is a hydrocarbyl group containing up to about 150 carbon atoms and will more often be an aliphatic hydrocarbyl group containing from about 4 to about 30 carbon atoms.

In one preferred embodiment, the hydrocarbyl amines which are useful in preparing the amine salts of the present invention are primary hydrocarbyl amines containing from about 4 to about 30 carbon atoms in the hydrocarbyl group, and more preferably from about 8 to about 20 carbon atoms in the hydrocarbyl group. The hydrocarbyl group may be saturated or unsaturated. Representative examples of primary saturated amines are those known as aliphatic primary fatty amines and commercially known as "Armeen®" primary amines (products available from Akzo Nobel Chemicals, Chicago, Ill.). Typical fatty amines include alkyl amines such as n-hexylamine, n-octylamine, n-decylamine, n-dodecylamine, n-tetradecylamine, n-pentadecylamine, n-hexadecylamine, n-octadecylamine (stearyl amine), etc. These Armeen primary amines are available in both distilled and technical grades. While the distilled grade will provide a purer reaction product, the desirable amides and imides will form in reactions with the amines of technical grade. Also suitable are mixed fatty amines such as Akzo's Armeen-C, Armeen-O, Armeen-OL, Armeen-T, Armeen-HT, Armeen-S and Armeen-SD.

In another preferred embodiment, the amine salts of the composition of this invention are those derived from tertiary-aliphatic primary amines having at least about 4 carbon atoms in the alkyl group. For the most part, they are derived from alkyl amines having a total of less than about 30 carbon atoms in the alkyl group.

Usually the tertiary aliphatic primary amines are monoamines represented by the formula

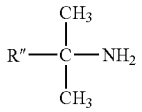

wherein R" is a hydrocarbyl group containing from one to about 30 carbon atoms. Such amines are illustrated by tertiary-butyl amine, tertiary-hexyl primary amine, 1-methyl-1-amino-cyclohexane, tertiary-octyl primary amine, tertiary-decyl primary amine, tertiary-dodecyl primary amine, tertiary-tetradecyl primary amine, tertiary-hexadecyl primary amine, tertiary-octadecyl primary amine, tertiary-tetracosanyl primary amine, tertiary-octacosanyl primary amine.

Mixtures of amines are also useful for the purposes of this invention. Illustrative of amine mixtures of this type are "Primene 81R" which is a mixture of $C_{11}C_{14}$ tertiary alkyl primary amines and "Primene JM-T" which is a similar mixture of $C_{18}$-$C_{22}$ tertiary alkyl primary amines (both are available from Rohm and Haas Company). The tertiary alkyl primary amines and methods for their preparation are well known to those of ordinary skill in the art and, therefore, further discussion is unnecessary. The tertiary alkyl primary amine useful for the purposes of this invention and methods for their preparation are described in U.S. Pat. No. 2,945,749 which is hereby incorporated by reference for its teaching in this regard.

Primary amines in which the hydrocarbon chain comprises olefinic unsaturation also are quite useful. Thus, the R' and R" groups may contain one or more olefinic unsaturation depending on the length of the chain, usually no more than one double bond per 10 carbon atoms. Representative amines are dodecenylamine, myristoleylamine, palmitoleylamine, oleylamine and linoleylamine. Such unsaturated amines also are available under the Armeen tradename.

Secondary amines include dialkylamines having two of the above alkyl groups including such commercial fatty secondary amines as Armeen®-2C and Armeen®-2HT, and also mixed dialkylamines where R' is a fatty amine and R" may be a lower alkyl group (1-9 carbon atoms) such as methyl, ethyl, n-propyl, i-propyl, butyl, etc., or R" may be an alkyl group bearing other non-reactive or polar substituents (CN, alkyl, carbalkoxy, amide, ether, thioether, halo, sulfoxide, sulfone) such that the essentially hydrocarbon character of the radical is not destroyed. The fatty polyamine diamines include mono-or dialkyl, symmetrical or asymmetrical ethylene diamines, propane diamines (1,2, or 1,3), and polyamine analogs of the above. Suitable commercial fatty polyamines are available under the Duomeen® tradename from Akzo Nobel. Suitable polyamines include Duomeen C(N-coco-1,3-diaminopropane), Duomeen S(N-soyaalkyl trimethylenediamine), Duomeen T (N-tallow-1,3-diaminopropane), or Duomeen OL (N-oleyl-1,3-diaminopropane).

The oil-soluble amine salts may be prepared by mixing the above-described phosphoric acid esters with the above-described amines at room temperature or above. Generally, mixing at room temperature for a period of from up to about one hour is sufficient. The amount of amine reacted with the phosphoric acid ester to form the salts of the invention is at least about one equivalent weight of the amine (based on nitrogen) per equivalent of phosphoric acid, and the ratio of equivalents generally is about one.

Methods for the preparation of such amine salts are well known and reported in the literature. See for example, U.S. Pat. Nos. 2,063,629; 2,224,695; 2,447,288; 2,616,905; 3,984,448; 4,431,552; 5,354,484; Pesin et al, *Zhumal Obshchei Khimii*, Vol, 31, No. 8, pp. 2508-2515 (1961); and PCT International Application Publication No. WO 87/07638.

Alternatively, in a preferred embodiment the salts may be formed in situ when the acidic phosphoric acid ester is blended with the above-described amines when forming a gear oil concentrate or the formulated gear oil itself. For example, primary hydrocarbyl amines that function as rust inhibitors may be added to a gear additive concentrate containing the acidic phosphoric acid ester leading to the formation of amine salts of phosphoric acid esters.

The phosphorous-containing compound generally will be used in the finished lubricant in an amount sufficient to provide about 100 to about 500 ppm phosphorus therein.

Alkylene Amine Friction Modifier (Compound c))

In one non-limiting embodiment the alkylene amine friction modifier is a long chain alkyl alkyleneamine. A non-limiting class of such friction modifiers are N-aliphatic hydrocarbyl-substituted trimethylenediamines in which the N-aliphatic hydrocarbyl-substituent is at least one straight chain aliphatic hydrocarbyl group free of acetylenic unsaturation and having in the range of about 14 to about 20 carbon atoms. The friction modifier compound can be used as a single type of compound or a mixture of different types of such compounds. The primary difference among the friction modifier compounds is the makeup of the particular hydrocarbyl substituent falling within the group as described above. A non-limiting example of such friction modifier compounds is N-oleyl-trimethylene diamine. This compound is commercially available under the trade designation Duomeen-O from Akzo Chemical Company. Other suitable compounds include N-tallow-trimethylene diamine (Duomeen-T) and N-coco-trimethylene diamine (Duomeen-C).

Dispersant Compound Containing Basic Nitrogen (Compound d))

Basic nitrogen-containing dispersants useful in this invention include hydrocarbyl succinimides; hydrocarbyl succinamides; mixed ester/amides of hydrocarbyl-substituted succinic acids formed by reacting a hydrocarbyl-substituted succinic acylating agent stepwise or with a mixture of alcohols and amines, and/or amino alcohols; Mannich condensation products of hydrocarbyl-substituted phenols, formaldehydes and polyamines; amine dispersants such as formed by reacting high molecular weight aliphatic or alicyclic halides with amines, such as polyalkylene polyamines, and also hydroxy-substituted polyamines, and polyoxyalkylene polyamines. These dispersants can be used singly or as mixtures thereof. Suitable examples of these dispersant compounds include those described and referenced in U.S. Pat. No. 5,612,295, which descriptions are incorporated herein by reference.

In one embodiment, the dispersant containing basic nitrogen may be a hydrocarbyl succinimide, a hydrocarbyl succinic ester-amide or a Mannich base of polyamine, formaldehyde and a hydrocarbyl phenol in which the hydrocarbyl substituent is a hydrogenated or unhydrogenated polyolefin group and preferably a polypropylene or isobutene group having a number average molecular weight (as measured by gel permeation chromatography) of from 250 to 10,000, and more preferably from 500 to 5,000, and most preferably from 750 to 2,500. In one non-limiting embodiment, the dispersant compound containing basic nitrogen is a polyolefin amide alkyleneamine.

In one non-limiting preferred embodiment, the dispersant containing basic nitrogen comprises an alkenyl succinimide. A suitable commercially available source of a dispersant compound containing a basic nitrogen for use as compound d) in this invention includes, for example, a polybutenyl succinimide ashless dispersant, which is commercially available as HiTEC®-633 from Ethyl Corporation. Other suitable alkenyl succinimides include those described and identified in U.S. Pat. No. 5,612,295, which descriptions are incorporated herein by reference.

Multi-functional Compounds

While the extreme pressure compound, antiwear compound, friction modifying compound, and dispersant compound are often described as separate classes of compounds herein, it will be appreciated that multi-functional compounds may be used in the lubricant compositions of the present invention which impart one or more than one of these different functions as a single type of chemical compound. For instance, sulfur and phosphorus containing compounds are available that can impart antiwear and extreme pressure effects to a lubricant composition. For example, thermally stable sulfur and phosphorus-containing compounds in this respect include reaction products of dicyclopentadiene and thiophosphoric acids, also referred to herein as dicyclopentadiene dithioates. Thiophosphoric acids suitable for use in preparing the anti-wear agents have the formula:

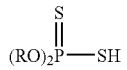

wherein R is a hydrocarbyl group having from 2 to 30, preferably 3 to 18 carbon atoms. In a preferred embodiment, R comprises a mixture of hydrocarbyl groups containing from 3 to 18 carbon atoms. Dithiothiadiazole is a non-limiting example of this type of phosphorous antiwear compound.

The dicyclopentadiene dithioates may be prepared by mixing dicyclopentadiene and a dithiophosphoric acid for a time and temperature sufficient to react the thioacid with the dicyclopentadiene. Typical reaction times range from 30 minutes to 6 hours, although suitable reaction conditions can readily be determined by one skilled in the art. The reaction product may be subjected to conventional post-reaction work up including vacuum stripping and filtering.

Other suitable multi-functional sulfur and phosphorus containing compounds include phosphorus substituted dimercapto thiadiazoles, such as those described in U.S. Pat. No. 4,107,168, which descriptions are incorporated herein by reference. Still other suitable multi-functional sulfur and phosphorus containing compounds include sulfur-containing phosphate ester reaction products, such as those described in U.S. Pat. No. 5,443,744, which descriptions are incorporated herein by reference. Additional suitable multi-functional sulfur and phosphorus containing compounds include reaction products of at least one nitrogen-containing compound, at least one phosphorus-containing compound, and at least one mono- or di-sulfide-containing alkanol, such as those compounds as described in U.S. Pat. No. 5,443,744, which descriptions are incorporated herein by reference. Further suitable multi-functional sulfur and phosphorus containing compounds include those produced by reacting O,O-dihydrocarbyl phosporodithioic acid with a monoepoxide or mixture thereof having 20-30 carbon atoms or vegetable oil epoxide, followed by reacting that product with phosphorus pentoxide to produce an acid phosphate intermediate, which is neutralized with at least one amine, such as described in U.S. Pat. No. 5,573,696, which descriptions are incorporated herein by reference.

Diluent Oil (Compound e))

The additive concentrates of this invention preferably contain a suitable diluent. The diluent typically is present in the concentrates in a minor amount. In a preferred embodiment, it is an oleaginous diluent of suitable viscosity. Such a diluent can be derived from natural or synthetic sources, or blends thereof. Use of mineral oils as the diluent of the top treat additive concentrate is preferred. Among the mineral (hydrocarbonaceous) oils are paraffin base, naphthenic base, asphaltic base, and mixed base oils. Synthetic oils include polyolefin oils (especially hydrogenated α-olefin oligomers), alkylated aromatics, polyalkylene oxides, aromatic ethers, and carboxylate esters (especially diesters), among others. The diluents can be light hydrocarbon base oils, both natural and (per a) synthetic.

Generally, the diluent oil generally will have a viscosity in the range of about 1 to about 40 cSt at 100° C., and preferably about 2 to about 15 cSt at 100° C. In one particular embodiment, the diluent oil is a 100 Neutral mineral oil having a viscosity of about 6 cSt at 100° C.

Base (Stock) Oil for Lubricants

The base oils, also referred to as base stocks, used in forming the gear oils of this invention can be any suitable natural or synthetic oil, or blend thereof, provided the lubricant has a suitable viscosity for use in gear applications. Natural sources of base oils include hydrocarbon oils of lubricating viscosity derived from petroleum, tar sands, coal, shale, and so forth, as well as natural oils such as rapeseed oil, and the like. Synthetic base stocks include, for example, poly-α-olefin oils (PAO, such as hydrogenated or unhydrogenated α-olefin oligomers), hydrogenated polyolefins, alkylated aromatics, polybutenes, alkyl esters of dicarboxylic esters, complex esters of dicarboxylic esters, polyol esters, polyglycols, polyphenyl ethers, alkyl esters of carbonic or phosphoric acids, polysilicones, fluorohydrocarbon oils, and mixtures thereof. The poly-α-olefins, for instance, typically have viscosities in the range of 2 to 100 cSt at 100° C., preferably 4 to 8 cSt at 100° C. They may, for example, be oligomers of branched or straight chain α-olefins having from 2 to 16 carbon atoms, specific examples being polypropenes, polyisobutenes, poly-1-butenes, poly-1-hexenes, poly-1-octenes and poly-1-decene. Included are homopolymers, interpolymers and mixtures.

In one embodiment, mineral oil base stocks are used such as for example conventional and solvent-refined paraffinic neutrals and bright stocks, hydrotreated paraffinic neutrals and bright stocks, naphthenic oils, cylinder oils, and so forth, including straight run and blended oils. In one more particular embodiment, synthetic base stocks can be used such as, for example, blends of poly-α-olefins with synthetic diesters in weight proportions (PAO:ester) ranging from about 95:5 to about 50:50.

The base oils will normally, but not necessarily always, have a viscosity range of SAE 50 to about SAE 250, and more usually about SAE 70 to about SAE 140.

Base stock oils suitable for use in the present invention may be made using a variety of different processes including but not limited to distillation, solvent refining, hydrogen processing, oligomerisation, esterification, and re-refining. For instance, poly-α-olefins (PAO) include hydrogenated oligomers of an α-olefin, the most important methods of oligomerisation being free radical processes, Ziegler catalysis, and cationic, Friedel-Crafts catalysis.

Certain of these types of base oils may be used for the specific properties they possess such as biodegradability, high temperature stability, or non-flammability. In other compositions, other types of base oils may be preferred for reasons of availability or lower cost. Thus, the skilled artisan will recognize that while various types of base oils discussed above may be used in the lubricant compositions of this invention, they are not necessarily equivalents of each other in every application.

Additive Concentrate Formulation

The additive concentrates of embodiments of this invention generally contain a minor amount of diluent and the remainder, the major amount, is comprised of the primary additives described herein, i.e., the extreme pressure S-containing compound, antiwear P-containing compound, alkylene amine friction modifier, and dispersant compound containing basic nitrogen. In general, additive concentrates include the following concentrations (in weight percent) of the primary additives according to one embodiment as indicated in Table I below.

TABLE I

| | General Range | Preferred Range |
|---|---|---|
| extreme pressure S-containing compound | 15-40% | 25-35% |
| antiwear P-containing compound | 10-40% | 25-35% |
| alkylene amine friction modifier | 2-25% | 10-20% |
| dispersant cmpd. containing basic nitrogen | 15-60% | 25-40% |

In one alternative embodiment, a multi-functional sulfur- and phosphorous-containing compound, such as one or more of those types as described above, is used in an amount of about 25-80 wt %, preferably about 50-70 wt %, to impart both extreme pressure and antiwear properties, in place of using separate compounds for these respective functions, while the balance of the composition remains the same as indicated above.

For use in gear oils, the additive concentrate are generally formulated with the diluent and the other additives described herein to have a kinematic viscosity of at least 12 cSt at 100° C.

In one preferred embodiment, the formulated additive concentrate is a homogenous, oil-soluble composition. As used herein, "oil-soluble" means the material under discussion can be dissolved in or be stably dispersed in a base oil to at least the minimum concentration needed for use as described herein. Preferably, the material has a solubility or dispersibility in the base oil well in excess of such minimum concentrations. However, the term does not mean that the material must dissolve or be dispersible in all proportions in the base oil.

Finished Lubricant Formulation

The finished lubricants of the present invention generally comprise a major amount of an oil of lubricating viscosity and a minor amount of the above-described additive concentrate. Typically, in gear oil applications, the lubricant compositions will contain the above-described base oil as the major component. In one embodiment, the finished lubricant will comprise from about 90 to about 98 percent by weight of base oil, and the oil-soluble additive concentrate will comprise about 10 to about 2 percent by weight, of the finished lubricant. In a specific, non-limiting embodiment, the oil-soluble soluble additive concentrate is contained in an amount of about 3.5 to about 6.0 percent by weight, while the base oil comprises the remainder of the finished lubricant.

In general, finished lubricants include the following concentrations (weight percent) of the primary additives in a base oil stock as indicated in Table II below.

TABLE II

| | General Range | Preferred Range |
|---|---|---|
| extreme pressure S-containing compound | 0.5-2.5% | 0.7-1.7% |
| antiwear P-containing compound | 0.2-2.0% | 0.5-1.3% |
| alkylene amine friction modifier | 0.1-1.0% | 0.2-0.8% |
| dispersant cmpd. containing basic nitrogen | 0.5-3.5% | 1.0-2.5% |

In one alternative embodiment, a multi-functional sulfur- and phosphorous-containing compound, such as described above, is used in an amount of about 0.7-2.5 wt %, preferably about 1.2-3.0 wt %, to impart both extreme pressure and antiwear properties, in place of using separate compounds for these respective functions, while the balance of the composition remains the same as indicated above.

For gear oil applications, the lubricants are generally formulated with the base oil and the other additives described herein to have a kinematic viscosity of at least 12 cSt at 100° C. The lubricant compositions of the present invention may be top treated with the additive concentrates to achieve multi-functional performance (i.e., both industrial and automotive applications).

For purposes herein, "an extreme pressure compound" generally means a lubricating substance that withstands heavy loads imposed on gear teeth; "an antiwear compound" generally means a substance that reduces loss of substance from the operating surface of a body occurring as a result of relative motion at the surface; a "friction modifier" or "friction modifying" material generally means a substance which enhances the ability of oil to remain slippery; and "a dispersant" generally means a substances that scatters a dispersed phase in various directions in a dispersion medium. These additives are used in amounts in oils effective to impart at least these respective functions. However, it will be appreciated that although the various additives described herein are described occasionally with reference to such associated respective functions, such as those defined above, that function may be one of other functions served or imparted by the same component and the definitions above should not be construed as a mandatory single limiting function of the respective additive. For instance, the characterizations herein of the "friction modifying" alkylene amine and "dispersant" containing basic nitrogen, as such, is exemplary and not limiting as to the functional properties imparted by these compounds, and the synergism achieved by the co-presence of these compounds in the lubricating composition is independent of and supplemental to these characterizations.

Other Additives

The finished lubricants and additive concentrates of this invention can contain various other conventional additives in a minor amount to partake of their attendant functions. These include, for example, defoamers, demulsifiers, antioxidants, copper corrosion inhibitors, rust inhibitors, pour point depressants, detergents, dyes, metal deactivators, supplemental friction modifiers, and diluents, and so forth. However, the supplemental additives must not interfere with the anticorrosive effects of the alkylene amine friction modifier and dispersant compound containing basic nitrogen.

Defoamers suitable for use in the present invention include silicone oils of suitable viscosity, glycerol monostearate, polyglycol palmitate, trialkyl monothiophosphates, esters of sulfonated ricinoleic acid, benzoylacetone, methyl salicylate, glycerol monooleate, glycerol dioleate and polyacrylates. Defoamers are generally employed at concentrations of up to about 1% in the additive concentrate.

Demulsifiers that may be used include alkyl benzene sulfonates, polyethylene oxides, polypropylene oxides, esters of oil soluble acids and the like. Such additives are generally employed at concentrations of up to about 3% in the additive concentrate.

Copper corrosion inhibitors include as thiazoles, triazoles and thiadiazoles. Examples include benzotriazole, tolyltriazole, octyltriazole, decyltriazole, dodecyltriazole, 2-mercaptobenzothiazole, 2,5-dimercapto-1,3,4-thiadiazole, 2-mercapto-5-hydrocarbylthio-1,3,4-thiadiazoles, 2-mercapto-5-hydrocarbyldithio-1,3,4-thiadiazoles, 2,5-bis(hydrocarbylthio)-1,3,4-thiadiazoles, and 2,5-bis-(hydrocarbyldithio)-1,3,4-thiadiazoles. The preferred compounds are the 1,3,4-thiadiazoles, especially the 2-hydrocarbyldithio-5-mercapto-1,3,4-dithiadiazoles and the 2,5-bis(hydrocarbyldithio)-1,3,4-thiadiazoles, a number of which are available as articles of commerce. Other suitable inhibitors of copper corrosion include ether amines; polyethoxylated compounds such as ethoxylated amines, ethoxylated phenols, and ethoxylated alcohols; imidazolines; and the like. See, for example, U.S. Pat. Nos. 3,663,561 and 4,097,387. Concentrations of up to about 3% in the concentrate are typical. Preferred copper corrosion inhibitors include ashless dialkyl thiadiazoles. One example of a commercially available ashless dialkyl thiadiazole is HiTEC® 4313 corrosion inhibitor, available from Ethyl Corporation.

Dialkyl thiadiazoles suitable for the practice of the instant invention are of the general formula:

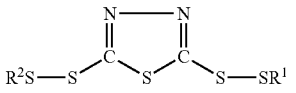

wherein $R^1$ is a hydrocarbyl substituent having from 6 to 18 carbon atoms; $R^2$ is a hydrocarbyl substituent having from 6 to 18 carbon atoms; and may be the same as or different from $R^1$. Preferably, $R^1$ and $R^2$ are about 9-12 carbon atoms, and most preferably $R^1$ and $R^2$ are each 9 carbon atoms.

Mixtures of dialkyl thiadiazoles of formula (I) with monoalkyl thiadiazoles may also be used within the scope of the present invention. Such mono alkyl thiadiazoles occur when either substituent $R^1$ or $R^2$ is H.

Antioxidants that may be employed in gear oil formulations include phenolic compounds, amines, phosphites, and the like. Amounts of up to about 5% in the concentrate are generally sufficient. The compositions of the present invention may include one or more anti-oxidants, for example, one or more phenolic antioxidants, hindered phenolic antioxidants, additional sulfurized olefins, aromatic amine antioxidants, secondary aromatic amine antioxidants, sulfurized phenolic antioxidants, oil-soluble copper compounds and mixtures thereof.

Suitable exemplary compounds include 2,6-di-tert-butylphenol, liquid mixtures of tertiary butylated phenols, 2,6-di-tert-butyl-4-methylphenol, 4,4'-methylenebis(2,6-di-tert-butylphenol), 2,2'-methylenebis(4-methyl-6-tert-butylphenol), mixed methylene-bridged polyalkyl phenols, 4,4'-thiobis(2-methyl-6-tert-butylphenol), N,N'-di-sec-butyl-p-phenylenediamine, 4-isopropylaminodiphenyl amine, alkylated diphenylamine and phenyl-α-naphthyl amine.

In the class of amine antioxidants, oil-soluble aromatic secondary amines; aromatic secondary monoamines; and others are suitable. Suitable aromatic secondary monoamines include diphenylamine, alkyl diphenylamines containing 1 to 2 alkyl substituents each having up to about 16 carbon atoms, phenyl-α-naphthylamine, alkyl- or aralkylsubstituted phenyl-α-naphthylamine containing one or two alkyl or aralkyl groups each having up to about 16 carbon atoms, alkyl- or aralkyl-substituted phenyl-α-naphthylamine containing one or two alkyl or aralkyl groups each having up to about 16 carbon atoms, alkylated p-phenylene diamines available from Goodyear under the tradename "Wingstay 100" and from Uniroyal, and similar compounds.

In the class of phenolic antioxidants, suitable compounds include ortho-alkylated phenolic compounds, e.g. 2-tert-butylphenol, 2,6-di-tertbutylphenol, 4-methyl-2,6-di-tertbutylphenol, 2,4,6-tri-tertbutylphenol, and various analogs and homologs or mixtures thereof; one or more partially sulfurized phenolic compounds as described in U.S. Pat. No. 6,096,695, the disclosure of which is incorporated herein by reference; methylene-bridged alkylphenols as described in U.S. Pat. No. 3,211,652, the disclosure of which is incorporated herein by reference.

Antioxidants may be optionally included in the fully formulated final inventive lubricating composition at from about 0.00 to about 5.00 weight percent, more preferably from about 0.01 wt. % to about 1.00 wt. %.

Rust inhibitors may be used in the practice of the present invention. This may be a single compound or a mixture of compounds having the property of inhibiting corrosion of ferrous metal surfaces. Such materials include oil-soluble monocarboxylic acids such as 2-ethylhexanoic acid, lauric acid, myristic acid, palmitic acid, oleic acid, linoleic acid, linolenic acid, behenic acid, cerotic acid, etc., and oil-soluble polycarboxylic acids including dimer and trimer acids, such as are produced from tall oil fatty acids, oleic acid, linoleic acid, or the like. Other suitable corrosion inhibitors include alkenylsuccinic acids in which the alkenyl group contains 10 or more carbon atoms such as, for example, tetrapropenylsuccinic acid, tetradecenylsuccinic acid, hexadecenyl-succinic acid, and the like; long-chain alpha, omega-dicarboxylic acids in the molecular weight range of 600 to 3000; and other similar materials. Products of this type are currently available from various commercial sources, such as, for example, the dimer and trimer acids sold under the HYSTRENE trademark by the Humco Chemical Division of Witco Chemical Corporation and under the EMPOL trademark by Emery Chemicals. Another useful type of acidic corrosion inhibitors are the half esters of alkenyl succinic acids having 8 to 24 carbon atoms in the alkenyl group with alcohols such as the polyglycols. Especially preferred rust inhibitors for use in the present invention include the primary and secondary amine compounds taught herein as the amine portion of the salt of a phosphoric acid ester as well as mixtures of said amines with other rust inhibitors described above. When an amine salt of a phosphoric acid ester is used as the phosphorus-containing anti-wear agent of the present invention, it may not be necessary to add additional amine-containing rust inhibitors to the gear oil formulation. In a preferred embodiment, the primary and secondary amines will contribute from 40 to 125 ppm nitrogen (on a weight/weight basis) to the formulated gear oil, whether they are classified as a rust inhibitor, part of the anti-wear system or a combination of both.

Supplemental friction modifiers may also be included to provide, for example, limited slip performance, or enhanced positraction performance. These friction modifiers typically may include such compounds as molybdenum containing compounds such as molybdenum carboxylates, molybdenum amides, molybdenum thiophosphates, and molybdenum thiocarbamates, and so forth. Other suitable friction modifiers include fatty amines or ethoxylated fatty amines; aliphatic fatty acid amides; ethoxylated aliphatic ether amines; aliphatic carboxylic acids; glycerol esters; aliphatic carboxylic ester-amides and fatty imidazolines; fatty tertiary amines, wherein the aliphatic group usually contains above about eight carbon atoms so as to render the compound suitably oil soluble. Also suitable are aliphatic substituted succinimides formed by reacting one or more aliphatic succinic acids or anhydrides with ammonia or other primary amines.

The diluents that may be used include the types previously described herein, and reference is made thereto.

In one embodiment, the inventive lubricant compositions may contain, or alternatively are essentially devoid, of conventional, ashless dispersants such as carboxylic-type ashless dispersants, Mannich base dispersants and the post-treated dispersants of these types as well as dispersant viscosity index improvers and dispersant pour point depressants. The ashless dispersants that may be eliminated from the lubricant composition of this invention include the polyamine succinimides, the alkenyl succinic acid esters and diesters of alcohols containing 1-20 carbon atoms and 1-6 hydroxyl groups, alkenyl succinic ester-amide mixtures and Mannich dispersants.

The lubricant compositions of the present invention are suitable to prevent gear-tooth ridging, rippling, pitting, welding, spalling, and excessive wear or other surface distress and objectionable deposits and not produce excessive wear, pitting or corrosion of bearing rollers under high torque conditions.

According to an embodiment of the present invention, the finished lubricants may have different primary viscosity grades which are indicated by the maximum temperature for viscosity of 150,000 cP according to ASTM D 2983 as defined in SAE J306 Automotive Gear and Lubricant Viscosity Classification.

As used herein, the term "percent by weight", unless expressly stated otherwise, means the percentage the recited component represents to the weight of the entire composition.

The following examples are presented to illustrate the invention, but the invention is not to be considered as limited thereto. In the following examples, parts are by weight unless indicated otherwise.

EXAMPLES

A series of oil formulations were prepared to examine the effect of various additives on the frictional and corrosion properties of the oil formulations.

Lubricant Additive Descriptions

Various surface-active agents were added to industrial oils to investigate the effects on corrosion resistance, oxidative stability, and fatigue performance. These additives can be placed in four broad classes; extreme pressure agents (EP), anti-wear compounds (AW), friction modifiers (FM), and dispersants (DISP).

In the examples, two EP compounds were examined: EP1, an olefin sulfide which specifically was HiTEC®-313 from Ethyl Corporation; and EP2, an alkyl polysulfide which was obtained as TPS-44 from Elf Atochem.

Three AW compounds were examined: AW1, an alkyl dithiothiadiazole which was HiTEC®-4313 from Ethyl Corporation; AW2, an alkyl thiophosphate ester which was HiTEC®-511T from Ethyl Corporation; and AW3, a mixture of alkylphosphorothioates and alkyl amines which was obtained as HiTEC®-833 from Ethyl Corporation.

Three FM compounds were examined: FM1, a long chain alkyl phosphonate which was HiTEC®-059 from Ethyl Corporation; FM2, a dithiocarbamate which was Molyvan®-822 from R.T. Vanderbilt Company, Inc.; and FM3, a long chain alkyl alkeneamine which was obtained as Duomeen-O from Akzo Chemical Company.

A DISP compound also was examined: DISP1, a polyolefin amide alkeneamine which was HiTEC®-633 from Ethyl Corporation.

In Example 1, EP1 is present in the finished oil at a concentration of 1.33 weight percent. In Examples 2 through 26 the concentrations of EP, AW, and FM in each fluid are 1.5, 1.0 and 0.5 weight percent, respectively. In Examples 11 through 18 and 23 through 26, DISP was present in the finished oils at a concentration of 1.0 weight percent. In all other examples the concentration of the additives are listed in the examples. All oils listed in the examples are blended in a 85:15 wt:wt mixture of PAOs (Durasyn 168 and Durasyn 174 from BP Oil Company) and ester (Priolube-3970 from Uniqema) at the above-indicated additive levels, and the finished oils also contained 0.45 weight percent of a standard industrial anti-rust/anti-oxidant package, HiTEC®)-2590A from Ethyl Corporation.

Testing Protocols

The anti-corrosion properties of the various oil formulations prepared were measured using the Ball Rust Test (BRT) and a modified DIN 51802 procedure. In the BRT, a ball bearing is immersed in an oil. Air saturated with acidic contaminants is bubbled through the oil for 18 hours at 49° C. After the 18-hour reaction period, the ball is removed from the test oil and the amount of corrosion on the ball is quantified using a light reflectance technique. The amount of reflected light is reported as an average gray value (AGV). The AGV for a fresh un-corroded ball is approximately 140. A totally corroded ball has an AGV result of less than 20. An oil with good anti-corrosion properties has a AGV greater than 50. In the modified DIN 51802 procedure, two bearings are washed, dried and cooled according to DIN 51802 and then dipped into test oil at room temperature. After oil is drained from the bearings for 1 hour the bearings are placed in the SKF Emcor test machine. The housings are then filled with 10 mls of test oil and 10 mls of 0.5% NaCl solution. The bearings are then run for 164 hours at a speed of 80 RPM. After the test the corrosion on the bearings is rated with a rating of 0 corresponding to no corrosion and a rating of 5 being the worst rating that can be assigned to an oil. An oil that can prevent bearing corrosion in the presence of salt water has a modified DIN 51802 result of 1 or less. In the examples, two modified DIN 51802 results are shown for each fluid since two bearings are tested. Oils must have both good BRT and modified DIN 51802 performance to be acceptable.

The results of Ball Rust Test (BRT) and a modified DIN 51802 procedure tests as performed on the various oil formulations are summarized in the tables below. For purposes of these experiments, a BRT value result of greater than 50 was deemed acceptable, and a Modified DIN 51802 value result of ≦1 was deemed acceptable. The various runs have been grouped into different tables so that relevant comments on the results for each test group can be interposed as the results are presented. The symbol "--" in the tables means "none".

TABLE 1

| Example (Oil Sample No.) | EP | AW | FM | DISP | BRT (AGV) | Mod. DIN 51802 |
|---|---|---|---|---|---|---|
| 1 | EP1 | — | — | — | 26 | 5.5 |
| 2 | EP1 | AW1 | FM1 | — | 20 | 2.2 |
| 3 | EP1 | AW2 | FM1 | — | 21 | 2.2 |
| 4 | EP1 | AW3 | FM1 | — | 17 | 0.0* |
| 5 | EP2 | AW1 | FM1 | — | 20 | 0.0* |
| 6 | EP2 | AW2 | FM1 | — | 16 | 0.0* |
| 7 | EP1 | AW3 | FM2 | — | 15 | 3.3 |
| 8 | EP1 | AW1 | FM2 | — | 13 | 0.0* |
| 9 | EP2 | AW2 | FM2 | — | 27 | 4.5 |
| 10 | EP2 | AW3 | FM2 | — | 20 | 3.3 |

Example 1 shows the BRT and modified DIN 51802 results for a fluid that contains EP1. As indicated by the unacceptably low BRT and Mod. DIN 51802 results, this fluid has very poor anti-corrosion properties. Examples 2 through 10 show oils containing different surface-active agents that may affect the anti-corrosion properties of oils. The corrosion results considered "acceptable" are indicated in the tables herein by "*". All of the combinations of EP, AW and FM used in the oils of Examples 2 through 10 have very poor BRT results (AGV<30). Only the oils of Examples 4, 5, 6 and 8, respectively, had acceptable modified DIN 51802 results.

TABLE 2

| Example (Oil Sample No.) | EP | AW | FM | DISP | BRT (AGV) | Mod. DIN 51802 |
|---|---|---|---|---|---|---|
| 11 | EP1 | AW1 | FM1 | DISP1 | 24 | 3.4 |
| 12 | EP1 | AW3 | FM1 | DISP1 | 14 | 0.0* |
| 13 | EP2 | AW1 | FM1 | DISP1 | 26 | 3.4 |
| 14 | EP2 | AW2 | FM1 | DISP1 | 20 | 1.2 |
| 15 | EP1 | AW1 | FM2 | DISP1 | 21 | 5.5 |
| 16 | EP1 | AW2 | FM2 | DISP1 | 17 | 2.3 |
| 17 | EP2 | AW2 | FM2 | DISP1 | 21 | 2.2 |
| 18 | EP2 | AW3 | FM2 | DISP1 | 16 | 0.1* |

Examples 11 through 18 show that the addition of dispersant does not improve the BRT performance of the oils containing FM1 or FM2. All oils in Examples 11 through 18 have BRT results less than 30. Only the oils of Examples 12 and 18, respectively, have acceptable modified DIN51802 results.

TABLE 3

| Example (Oil Sample No.) | EP | AW | FM | DISP | BRT (AGV) | Mod. DIN 51802 |
|---|---|---|---|---|---|---|
| 19 | EP1 | AW1 | FM3 | — | 42 | 0.0* |
| 20 | EP1 | AW3 | FM3 | — | 110* | 2.2 |
| 21 | EP2 | AW2 | FM3 | — | 44 | 0.0* |
| 22 | EP2 | AW3 | FM3 | — | 22 | 1.2 |

Examples 19 through 22 show that using FM3 instead of FM1 or FM2 improves BRT results. The oils of Examples 19, 20 and 21, respectively, have BRT results greater than 40, while the BRT results for fluids containing FM1 or FM2 are all less than 30 (Examples 2 through 18). However, only the oil of Example 20, which had an acceptable BRT result, had a poor modified DIN51802 result.

TABLE 4

| Example (Oil Sample No.) | EP | AW | FM | DISP | BRT (AGV) | Mod. DIN 51802 |
|---|---|---|---|---|---|---|
| 23 | EP1 | AW2 | FM3 | DISP1 | 86* | 0.1* |
| 24 | EP1 | AW3 | FM3 | DISP1 | 125* | 0.1* |
| 25 | EP2 | AW1 | FM3 | DISP1 | 110* | 0.0* |
| 26 | EP2 | AW3 | FM3 | DISP1 | 121* | 0.1* |

These results for inventive Examples 23 through 26, which represent embodiments of the present invention, show that the combination of FM3 and DISP1 produced lubricant oils with both acceptable BRT and acceptable modified DIN51802 anti-corrosion results.

Supplemental Experiments

Additional performance properties were measured for the sample oils of Examples 19-26 to investigate their corrosion resistance in water, fatigue performance, and oxidative stability properties. For comparison purposes, two comparison oils were formulated with commercial industrial oil additive packages but without the combined EP, AW, FM and DISP additives described herein, in a mixture of PAO and ester as the base oil. These comparative industrial oils were designated C1 and C2. For C1, the additive package used included 3 wt % HiTEC® 4313, 9 wt % HiTEC® 833, and 29 wt % HiTEC® 633, and 59 wt % of a standard industrial anti-rust/anti-oxidant package, HiTEC® 2590A, with each obtained from Ethyl Corporation. The first two mentioned components are known antiwear compounds while the third is a known dispersant component. This comparison oil contained no extreme pressure compound or friction modifier. For C2, the additive package used included 72 wt % HiTEC® 313 and 4 wt % HiTEC® 4313, and 24 wt % of a standard industrial anti-rust/anti-oxidant package, HiTEC® 2590A, with each component obtained from Ethyl Corporation. The first two components are known antiwear compounds, and no dispersant or friction modifier were added to the oil of C2. These comparison additive packages C1 and C2 were added at a level of 0.76 wt % and 1.85 wt %, respectively, to the base oil. The base oil was comprised of the same base oil used in Examples 19-26.

The performance of oil samples of Examples 19-26 were also investigated at more severe conditions in which the samples of each test oil were modified before the tests to further include 0.5% distilled water.

Supplemental Test Protocols

Boundary friction coefficients were measured using a PCS Instruments' High Frequency Reciprocating Rig (HFRR). Boundary friction was measured between a steel ball and a steel plate. The ball was oscillated across the steel plate at 20 Hz over a one-millimeter path, with an applied load of 4.0 N. Measurements were made at 100° C. These test conditions were chosen to minimize the formation of oil films during the test. The standard deviation associated with the friction coefficient measurement is listed in the appropriate tables.

Optical interferometry was used to measure the formation of oil films in contact zones. Suitable techniques for implementing this measurement are described in Johnston, G., et al., "The Measurement and Study of Very Thin Lubricant Films in Concentrated Contacts," Tribol. Trans., 34 187-194 (1991); Hamrock, B., et al., "Isothermal Elastohydrodynamic Lubrication of Point Contacts: Part III-Fully Flooded Results," ASME J Lubr. Techn., 99(2), 264-276 (1977), which descriptions are incorporated herein by reference.

In this technique a steel ball and glass disk form a contact. The load between the ball and disk is approximately 17N, which results in approximately 0.5 GPa of contact pressure. The contact pressure causes the ball and disk to elastically conform to one another. The ball is immersed in oil, and when the ball is rotated, oil is pulled through the contact zone forming an oil film. Film thickness results reported here were measured at 100° C. and at an entrainment speed of 1.0 m/s. The standard deviation associated with the film thickness measurement is listed in the appropriate tables.

Pressurized differential scanning calorimetry (PDSC) and ASTM D 2893 oxidation tests were used to assess the oxidative stability of the test oils. See, e.g., Hsu, S., et al., D.B., "Evaluation of Automotive Crankcase Lubricants by Differential Scanning Calorimetry", SAE Paper No. 821252 (1982). In PDSC tests, a 0.8 mg sample was placed in a test cell, which was pressurized to 100 psi with air. The temperature of the test cell was increased at a rate of 10° C./hr until an exothermic reaction was detected. The onset temperature for this reaction was recorded. In D 2893 tests, oils were oxidized at 95° C. for 600 hours rather than the standard 312 hours, in order to increase the test severity. The film thickness and boundary frictional properties of the oxidized oils from the D 2893 tests were measured along with the kinematic viscosity of the fresh and oxidized oils.

The boundary friction, film thickness and anti-corrosion properties of fluids were used to calculate fatigue life in FZG pitting tests. The manner of making this calculation is described, for example, in Li, S., et al, "Investigation of Fatigue Modes in the FZG Pitting Test," SAE Paper No. 2003-01-3222 (2003), which descriptions are incorporated herein by reference. The standard deviation associated with the calculation of predicted pitting life is listed in the appropriate tables.

Finally, the Ball Rust Test (BRT) and a modified DIN 51802 test procedure were conducted in the same manner as previously described herein.

Anti-Corrosion Properties of the Oils of Examples 19-26

The anti-corrosion properties measured for the test oils are indicated in Table 5 below.

TABLE 5

| Example (Oil sample No.) | BRT [AGV] std. dev. = +/−5 No added water | BRT [AGV] std. dev. = +/−5 0.5% Water added | Mod. DIN 51802 Rust Rating 0.5% Salt Water added |
|---|---|---|---|
| C1 | 26 | 13 | 5.5 |
| C2 | 26 | 16 | 5.5 |
| 24 | 125 | 33 | 0.1 |
| 23 | 86 | 13 | 0.1 |
| 20 | 110 | 14 | 2.2 |
| 19 | 42 | 19 | 0.0 |
| 26 | 121 | 52 | 1.1 |
| 25 | 110 | 40 | 0.0 |
| 22 | 22 | 12 | 1.2 |
| 21 | 44 | 14 | 0.0 |

Table 5 shows the AGV results from BRT tests for the oils with and without 0.5% distilled water. The industrial oils (C1 and C2) did not control corrosion in the BRT in the absence of water (AGV are 26 for both fluids). On the other hand, the experimental oils of Examples 20, 23, 24, 25 and 26 in particular had excellent anti-corrosion properties as indicated by the BRT test results. The presence of water is seen as affecting the oils' ability to prevent corrosion in BRT tests. For example, the AGV result for the Example 24 oil is 125 in the absence of water and is 33 when water is added to the oil. All of the oils tested form stable emulsions since emulsions were formed immediately after blending with water and remained for weeks after blending. Emulsion formation indicates that some surface-active agents in the oil are present at the water-oil interface. If these surface-active agents remain at the water-oil interface during the BRT, they will not be able to increase film formation on the metal ball to prevent corrosion.

Table 5 also shows the rust rating on bearings from DIN 51802 tests. There are two results for each oil since duplicate DIN 51802 tests were performed. The two comparison oils C1 and C2 performed very poorly in the DIN 51802 test (the rust rating is 5 for both oils). By contrast, the example oils all have rust ratings of 2 or less. For some oils (viz. Examples 19, 21, and 22), BRT results are poor (i.e., AGV less than 45), while DIN 51802 ratings are good. The BRT should be a more severe corrosion test than the DIN 51802 test, since strong acids are added to the oils in the BRT while salt water is added to the oils in the DIN 51802 test. The experimental oils which best controlled AGV in BRT tests and rust in DIN 51802 tests are oils of Examples 25 and 26 (AGV greater than 40 in presence or absence of water and DIN 51802 ratings of 1 or less).

Film Thickness, Boundary Friction and Fatigue Life Properties of Oils of Examples 19-26

Table 6 below shows the film thickness and boundary friction coefficient values measured for the comparison industrial oils and experimental oils in the absence of water. These two physical properties along with the AGV from the BRT were also used to calculate predicted hours to pitting failures in FZG pitting tests, as a measure of fatigue life. The results are indicated in Table 6.

TABLE 6

| Example (Oil sample No.) | Film Thickness 100° C.; 1 m/s [nm] std. dev. = +/−5 nm | Boundary Friction Coef. 100° C. std. dev. = +/−0.003 | Predicted Hours To Pitting Failure In FZG Test std. dev. = +/−10 hrs. |
|---|---|---|---|
| C1 | 134 | 0.105 | 91 |
| C2 | 138 | 0.115 | 80 |
| 24 | 127 | 0.075 | 164 |
| 23 | 137 | 0.104 | 118 |
| 20 | 130 | 0.081 | 154 |
| 19 | 130 | 0.125 | 57 |
| 26 | 131 | 0.084 | 154 |
| 25 | 129 | 0.124 | 82 |
| 22 | 124 | 0.089 | 101 |
| 21 | 138 | 0.112 | 93 |

As seen from the results in Table 6, there was very little difference between the film thicknesses of the oils tested. The oils of Examples 21 and 23 formed the thickest films of any of the experimental oils (138 nm and 137 nm, respectively). The boundary friction coefficients for the experimental oils varied, which was thought possibly attributable to the fact that they were formulated with different surface-active agents (AW and EP).

It is thought that the difference in boundary friction and AGV results for each oil, caused the differences in the predicted hours to pitting shown in the Table 6. The oil of Example 19, which has the highest boundary friction coefficient (0.125, see Table 6) and a low AGV (42, see Table 5), has the worst predicted hours to pitting (57 hours. see Table 6). The oil of Example 24, which has the lowest boundary friction coefficient (0.075) and the highest AGV (125), has the highest predicted hours to pitting (164 hours). Furthermore, there were several experimental oils, viz., Examples 20, 24, and 26, that have significantly better predicted fatigue lives (164, 154 and 154 hrs, respectively) than do the two comparison oils C1 and C2.

Effect of Water on Film Thickness, Boundary Friction Properties and Fatigue Life of Examples 19-26

Table 7 below shows the film thickness, boundary friction coefficients, and predicted hours to pitting failure, for the test oils in the presence of 0.5% water.

TABLE 7

| Example (Oil sample No.) | Film Thickness 100° C.; 1 m/s [nm] std. dev. = +/−5 nm | Boundary Friction Coef. 100° C. std. dev. = +/−0.003 | Predicted Hours To Pitting Failure In FZG Test std. dev. = +/−10 hrs. |
|---|---|---|---|
| C1 | 127 | 0.103 | 78 |
| C2 | 106 | 0.104 | 47 |
| 24 | 127 | 0.087 | 112 |
| 23 | 124 | 0.086 | 102 |
| 20 | 95 | 0.083 | 63 |
| 19 | 100 | 0.085 | 69 |
| 26 | 126 | 0.091 | 111 |
| 25 | 106 | 0.107 | 50 |
| 22 | 115 | 0.091 | 79 |
| 21 | 110 | 0.088 | 77 |

For all fluids except the oil of Example 24, water causes a decrease in film thickness. For example, the film thickness of comparison oil C2 is 138 nm in the absence of water and 106 nm in the presence of water. There are also significant changes in the boundary friction coefficients of the fluids when water is added to them. The friction coefficient for the oil of Example 24 increases from 0.075 to 0.087 when water is added to this fluid. On the other hand, for the oil of Example 23 the friction coefficient decreases from 0.104 to 0.086. According to the fatigue life prediction model described by Li et al. referenced and identified above, a decrease in film thickness should decrease fatigue life and a decrease in friction should increase fatigue life. Therefore, to assess the performance of these fluids we need to compare their predicted fatigue lives. Except for the oil of Example 19, which has a low predicted fatigue life, the predicted fatigue life for all oils decreased when water was added to them. The effect of water is quite significant in some cases, for example, the predicted fatigue life for the oil of Example 20 decreased from 154 hours in the absence of water to 63 hours in the presence of water.

Oxidative Stability of Oils of Examples 19-26

Table 8 shows the oxidation onset temperatures for the test oils as was measured by PDSC, as well as KV100 measurements before and after D 2983 Testing.

TABLE 8

| Example (Oil sample No.) | Onset Temperature (° C.) | KV100 Fresh Oil [cSt] | KV100 Oxidized Oil [cSt] | Percent Change in KV100 |
|---|---|---|---|---|
| C1 | 230 | 23.53 | 24.03 | 2% |
| C2 | 238 | 23.06 | 23.68 | 3 |
| 24 | 252 | 23.01 | 23.95 | 4 |
| 23 | 252 | 23.44 | 23.73 | 1 |
| 20 | 245 | 22.71 | 23.62 | 4 |
| 19 | 248 | 23.03 | 23.24 | 1 |
| 26 | 250 | 22.08 | 24.38 | 10 |
| 25 | 243 | 22.36 | 23.96 | 7 |
| 22 | 235 | 22.06 | 23.74 | 8 |
| 21 | 238 | 22.42 | 23.75 | 6 |

All of the experimental wind turbine oils except for the oils of Examples 21 and 22 have higher oxidation onset temperatures than the comparison industrial oils C1 and C2. More importantly, the oxidation onset temperatures for all oils are greater than 230° C. indicating excellent oxidation control by these fluids. See, e.g., the Hsu et al. publication referenced and identified above. Table 8 shows the 100° C. kinematic viscosities (KV100) of the fresh oils and end of test oils from D 2893 tests along with the percent increase in KV100, which occurs during the test. The greatest increase in KV100 is 10% for the oil of Example 26, confirming that all oils control oxidation even under extreme conditions.

Even though all of the oils studied control oxidation, oxidation of the oils does affect their film formation and friction reducing properties.

Table 9 below shows the film thickness, friction coefficients, and predicted fatigue life for the oils after oxidation in D 2983 tests. The D 2893 tests performed here were run for 600 hours rather than the typical 312 hours.

TABLE 9

| Example (Oil sample No.) | Film Thickness 100° C.; 1 m/s [nm] std. dev. = +/−5 nm | Boundary Friction Coef. 100° C. std. dev. = +−0.003 | Predicted Hours To Pitting Failure In FZG Test std. dev. = +/−10 hrs. |
|---|---|---|---|
| C1 | 114 | 0.106 | 58 |
| C2 | 117 | 0.114 | 50 |
| 24 | 124 | 0.098 | 123 |
| 23 | 107 | 0.109 | 65 |
| 20 | 107 | 0.097 | 93 |
| 19 | 100 | 0.100 | 53 |
| 26 | 127 | 0.105 | 114 |
| 25 | 113 | 0.104 | 91 |
| 22 | 99 | 0.097 | 50 |
| 21 | 115 | 0.107 | 64 |

When oils are oxidized the film formation properties of all oils stay the same or decrease. For example, the film thickness of fresh oil C1 is 134 nm (see Table 6) and the film thickness of oxidized C1 is 114 nm. The film thickness of fresh oil of Example 24 is 127 nm and is 124 nm after the oil of Example 24 is oxidized, which is statistically equivalent to the result for the fresh oil. When oils are oxidized the frictional properties of the oils increase or decrease depending upon the additives present in the fluid. The friction coefficient of the oil of Example 24 increases from 0.075 to 0.098 when this oil is oxidized. On the other hand the friction coefficient of the oil of Example 25 decreases from 0.124 to 0.104 when this oil is oxidized. The changes in film thickness and friction caused by oxidation result in a decrease in predicted fatigue life for most fluids. The oil of Example 25 was the exception as the predicted hours to pitting for this oil were statistically equivalent before and after oxidation (82 hours versus 91 hours, respectively), since the standard deviation associated with the calculation of predicted hours to pitting was +/−10 hours for these studies.

Statistical Analysis

Statistical analyses were performed using the results for Examples 19 through 26 to quantify the effectiveness of the EP, AW, and DISP used in these formulations. The statistical analyses applied general principles of linear regression and regression on several independent variables such as those described by Brownlee, K., STATISTICAL THEORY AND METHODOLOGY 1N SCIENCE AND ENGINEERING, John Wiley and Sons, Inc., Chapters 11, 13 (1960), which descriptions are incorporated herein by reference. Using these regression analyses, the predicted hours to pitting for each of the various oils containing each additive was averaged to provide a grand average value relative to each additive, and these values were compared to the results for the other additives. The grand average for the predicted hours to pitting of fresh oils containing AW2 was 143 hours (see results for AW2 in Table 10). Similarly the grand average for oils containing AW1, AW3 and the other additives can be calculated and are displayed in Table 10. The results in Table 10 show that (on average) fresh oils containing AW2 can be expected to improve fatigue life by 37 hours (143-106) versus AW1 and by 73 hours (143-70) versus AW3. In oils contaminated with water there was no difference in the performance of AW 1 and AW2 and these additives can be expected to improve fatigue life by ~30 hours versus AW3. For oxidized oils AW2 can be expected to improve fatigue life by 30 hours versus AW1 and by 23 hours versus AW3. Similar comparisons show that EP1 was preferred in fresh oils but there was no statistical difference in the performance of EP1 and EP2 in the water contaminated oils or oxidized oils. Again, the standard deviation for the calculation of predicted fatigue life was +/−10 hours. Finally, the addition of dispersant to the oils improved predicted fatigue life by 29, 22, and 33 hours for fresh, water-contaminated and oxidized oils, respectively.

TABLE 10

| Additive | Grand Avg. Predicted Hours to Pitting for Fresh Oils | Grand Avg. Predicted Hours to Pitting for Oils Contaminated with Water | Grand Avg. Predicted Hours to Pitting for Oxidized Oils |
|---|---|---|---|
| AW1 | 106 | 90 | 65 |
| AW2 | 143 | 91 | 95 |
| AW3 | 70 | 60 | 72 |
| EP1 | 123 | 87 | 84 |
| EP2 | 108 | 79 | 80 |
| No Dispersant | 101 | 72 | 65 |
| Dispersant | 130 | 94 | 98 |

Additional analyses to show that there is a synergism between FM3 and DISP1, on the average BRT result for oils containing FM1, FM2 and FM3, with and without dispersant, are shown in Table 11. These average results are compared to the BRT results for the oil of Example 1. The standard deviation in the measurement of AGV is +/−5 units. Therefore, the average BRT results for fluids containing FM1 or FM2 are all worse or statistically equivalent to the BRT results for Example 1 that contains no FM or dispersant. Furthermore, adding dispersant to oils containing FM1 or FM2 does not improve BRT results. Using FM3 improves BRT results by 107% (54-26/26). Unexpectedly, using FM3 and DISP1 together improves BRT results by 327% (111-26/26). The expected percent increase in BRT for the combination of FM3 and DISP1 is 107%, which is the increase observed for FM3, since DISP1 does not improve BRT results when added to fluids with the other FMs. Therefore, there is an unexpected improvement in BRT results due to the combination of FM3 and DISP1. The average results for oils containing different FMs are indicated in Table 11 below.

TABLE 11

| FM/Dispersant Combination | Examples Used in Avg. | Avg. AGV from BRT | % Increase vs. Ex. 1 |
|---|---|---|---|
| None/None | 1 | 26 | — |
| FM1/None | 2-6 | 19 | decrease |
| FM1/DISP1 | 11-14 | 21 | decrease |
| FM2/None | 7-10 | 19 | decrease |

TABLE 11-continued

| FM/Dispersant Combination | Examples Used in Avg. | Avg. AGV from BRT | % Increase vs. Ex. 1 |
|---|---|---|---|
| FM2/DISP1 | 15-18 | 19 | decrease |
| FM3/None | 19-22 | 54 | 107 |
| FM3/DISP1 | 23-24 | 111 | 327 |

Referring to Table 12 below, the oils of Examples 27 through 30, which represent embodiments of the present invention, were prepared and tested. Examples 27-30 show different concentrations of FM3 and DISP1 that are effective. In Examples 23 through 26, the concentration of FM3 and DISP1 was 0.5 and 1.0 weight percent, respectively. So the ratio of FM3 to DISP1 is 0.50. Examples 27 through 30 show that ratio of FM3 to DISP1 can be as low as 0.13 and the combination of FM3 and DISP1 is still effective. Examples 23 through 30 also show that the combination of FM3 and DISP1 can be used with a variety of EP and AW compounds.

TABLE 12

| Example (Oil Sample No.) | EP | EP wt % | AW3 wt % | FM3 wt % | DISP1 wt % | ratio FM3/ DISP1 | BRT (AGV) | Mod. DIN 51802 |
|---|---|---|---|---|---|---|---|---|
| 27 | EP1 | 1.5 | 1.00 | 0.50 | 1.5 | 0.33 | 108 | 0.0 |
| 28 | EP1 | 1.0 | 0.75 | 0.35 | 1.5 | 0.23 | 106 | 0.0 |
| 29 | EP2 | 1.5 | 1.00 | 0.50 | 2.5 | 0.20 | 117 | 0.0 |
| 30 | EP2 | 1.0 | 0.60 | 0.25 | 2.0 | 0.13 | 59 | 0.0 |

INDUSTRIAL APPLICABILITY

Among other geared device applications, the wind turbine industry needs improved lubricating formulations for use in gear boxes. This invention provides an improved gear oil that is water stable and oxidatively stable which is well-suited for the demands of that and other geared device applications, as well as other lubricant and functional fluid applications.

The disclosures of each patent or publication cited in the foregoing disclosure are incorporated herein by reference as if fully set forth herein.

While the preferred embodiments have been fully described and depicted for the purposes of explaining the principles of the present invention, it will be appreciated by those skilled in the art that modifications and changes may be made thereto without departing from the scope of the invention set forth in the appended claims.

What is claimed:

1. An additive concentrate, comprising:

a) an extreme pressure compound comprising a sulfur-containing compound;

b) an antiwear compound comprising a phosphorus-containing compound;

c) a friction modifying compound comprising an alkylene amine compound comprising an N-aliphatic hydrocarbyl-substituted trimethylenediamine, wherein the N-aliphatic hydrocarbyl-substituent comprises at least one straight chain aliphatic hydrocarbyl group free of acetylenic unsaturation and having about 14 to about 20 carbon atoms;

d) a dispersant compound containing basic nitrogen, wherein the dispersant compound comprises a polyolefin amide compound; and e) a diluent oil, wherein any of compounds a), b), c), or d) can be the same or different compounds.

2. The additive concentrate according to claim 1, wherein the dispersant compound comprises a polyolefin amide alkylene amine.

3. The additive concentrate according to claim 1, wherein the alkylene amine compound is selected from the group consisting of N-oleyl-trimethylene diamine, N-tallow-trimethylene diamine, N-coco-trimethylene diamine, and combinations thereof.

4. The additive concentrate according to claim 1, comprising about 15 to about 40 wt. % extreme pressure compound comprising a sulfur-containing compound; about 10 to about 40 wt. % antiwear compound comprising a phosphorus-containing compound, which is a different compound than the sulfur-containing compound; about 2 to about 25 wt. % friction modifying alkylene amine compound; about 15 to about 60 wt. % dispersant compound containing basic nitrogen; and a minor amount of diluent oil.

5. The additive concentrate according to claim 1, wherein compound a) is present in an amount sufficient to provide at least about 1,000 ppm sulfur and the compound b) is present in an amount sufficient to provide about 100 to about 500 ppm phosphorus to the concentrate.

6. The additive concentrate according to claim 1, wherein the antiwear compound comprises a phosphorus-containing antiwear compound selected from the group consisting of oil-soluble amine salts of a phosphoric ester, and reaction products of dicyclopentadiene and thiophosphoric acid.

7. The additive concentrate according to claim 1, wherein the extreme-pressure compound comprises a sulfur-organic compound including a sulfur-containing species bound directly to carbon or to more sulfur.

8. The additive concentrate according to claim 1, wherein the sulfur-containing compound and the phosphorus-containing compound are the same chemical compound which contains both sulfur and phosphorus.

9. The additive concentrate according to claim 1, wherein the sulfur-containing compound and the phosphorus-containing compound are different chemical compounds from each other.

10. The additive concentrate according to claim 1, further comprising an ashless dispersant.

11. The additive concentrate according to claim 1, essentially devoid of an ashless dispersant.

12. A composition, comprising:

a) an extreme pressure compound comprising a sulfur-containing compound;

b) an antiwear compound comprising a phosphorus-containing compound;

c) a friction modifying compound comprising an alkylene amine compound comprising an N-aliphatic hydrocarbyl-substituted trimethylenediamine, wherein the N-aliphatic hydrocarbyl-substituent comprises at least one straight chain aliphatic hydrocarbyl group free of acetylenic unsaturation and having about 14 to about 20 carbon atoms;

d) a dispersant compound containing basic nitrogen, wherein the dispersant compound comprises a polyolefin amide compound; and e) base oil, wherein any of compounds a), b), c), or d) can be the same or different compounds.

13. The composition according to claim 12, wherein the dispersant compound comprises a polyolefin amide alkylene amine.

14. The composition according to claim 12, wherein the alkylene amine compound is selected from the group consisting of N-oleyl-trimethylene diamine, N-tallow-trimethylene diamine, N-coco-trimethylene diamine, and combinations thereof.

15. The composition according to claim 12, comprising about 0.5 to about 2.5 wt. % extreme pressure compound comprising a sulfur-containing compound; about 0.2 to about 2.0 wt. % antiwear compound comprising a phosphorus-containing compound, which is a different compound than the sulfur-containing compound; about 0.1 to about 1.0 wt. % friction modifying alkylene amine compound; about 0.5 to about 3.5 wt. % dispersant compound containing basic nitrogen; and a major amount of base oil.

16. The composition according to claim 12, wherein compound a) is present in an amount sufficient to provide at least about 1,000 ppm sulfur and the compound b) is present in an amount sufficient to provide about 100 to about 500 ppm phosphorus to the concentrate.

17. The composition according to claim 12, wherein the base oil has a viscosity in the range of SAE 50 to SAE 250.

18. The composition according to claim 12, wherein the base oil has a viscosity in the range of SAE 70W to SAE 140.

19. The composition according to claim 12, wherein the antiwear compound comprises a phosphorus-containing antiwear compound selected from the group consisting of oil-soluble amine salts of a phosphoric ester, and reaction products of dicyclopentadiene and thiophosphoric acid.

20. The composition according to claim 12, wherein the extreme-pressure compound comprises a sulfur-organic compound including a sulfur-containing species bound directly to carbon or to more sulfur.

21. The composition according to claim 12, wherein the extreme pressure compound comprises a metal-free sulfur-containing extreme pressure agent selected from the group consisting of sulfurized olefin, and polysulfide composed of one or more groups represented by the formula $R_a$-$S_x$-$R_b$ where $R_a$ and $R_b$ are hydrocarbyl groups each of which contains 3 to 18 carbon atoms and x is in the range of from 2 to 8.

22. The composition according to claim 12, wherein the sulfur-containing compound and the phosphorus-containing compound are the same chemical compound which contains both sulfur and phosphorus.

23. A method of manufacturing a composition comprising blending a) base oil; b) an extreme pressure compound comprising a sulfur-containing compound; c) an antiwear compound comprising a phosphorus-containing compound that is the same compound or a different compound as the sulfur-containing compound; d) a friction modifying compound comprising an alkylene amine compound; and e) a dispersant compound containing basic nitrogen, wherein the dispersant compound comprises a polyolefin amide compound.

24. A method of lubricating a gear comprising using as the lubricant for said gear a composition according to claim 12.

25. A lubed gear-box comprising a gear within a gear-box lubricated according to the method of claim 24.

26. A wind turbine gear assembly lubricated with a composition according to claim 12.

27. A method of lubricating a wind turbine gear assembly comprising using as the lubricant for said gear assembly a composition according to claim 12.

* * * * *